United States Patent [19]

Sawada

[11] Patent Number: 4,935,779

[45] Date of Patent: Jun. 19, 1990

[54] SINGLE SCAN, MULTICOLOR IMAGING FORMING APPARATUS CAPABLE OF ADJUSTING THE IMAGE DENSITY OF EACH COLOR

[75] Inventor: Shigeru Sawada, Osaka, Japan

[73] Assignee: Minolta Camera Kabushiki Kaisha, Osaka, Japan

[21] Appl. No.: 368,056

[22] Filed: Jun. 19, 1989

Related U.S. Application Data

[63] Continuation of Ser. No. 172,493, Mar. 24, 1988, abandoned.

[30] Foreign Application Priority Data

Mar. 25, 1987 [JP] Japan ..... 62-75489

[51] Int. Cl.[5] ..... G03G 15/00

[52] U.S. Cl. ..... 355/228; 355/233; 355/326; 355/246

[58] Field of Search ..... 355/228, 233, 326, 246

[56] References Cited

U.S. PATENT DOCUMENTS

| | | | |
|---|---|---|---|
| 2,910,963 | 11/1959 | Herman | 118/657 X |
| 3,572,288 | 6/1968 | Turner | 118/637 |
| 3,914,043 | 10/1975 | McVeigh | 355/4 |
| 3,960,445 | 6/1976 | Drawe | 355/4 |
| 3,967,891 | 7/1976 | Rippstein | 355/3 R |
| 4,099,860 | 7/1978 | Connin | 355/14 R |
| 4,346,982 | 8/1982 | Nakajima et al. | 355/3 R |
| 4,373,798 | 2/1983 | Tsukada et al. | 355/3 DD |
| 4,572,102 | 2/1986 | Yuge et al. | 355/14 D |
| 4,579,443 | 4/1986 | Abuyama et al. | 355/4 |
| 4,619,514 | 10/1986 | Ide | 355/3 R |
| 4,627,707 | 12/1986 | Tani et al. | 355/14 R |
| 4,634,259 | 1/1987 | Oishi et al. | 355/4 |
| 4,641,602 | 2/1987 | Kasai | 118/653 |
| 4,657,376 | 4/1987 | Ide | 355/14 R |
| 4,659,211 | 4/1987 | Oka | 355/14 D |
| 4,666,288 | 5/1987 | Watanabe | 355/7 X |
| 4,685,794 | 8/1987 | Watanabe | 355/7 |
| 4,690,543 | 9/1987 | Watanabe | 355/4 |
| 4,710,016 | 12/1987 | Waatanabe | 355/4 |
| 4,720,730 | 1/1988 | Ito | 355/4 |
| 4,723,148 | 2/1988 | Hamakawa | 355/14 SH |
| 4,728,985 | 3/1988 | Nakashima et al. | 355/7 |
| 4,736,223 | 4/1988 | Suzuki . | |
| 4,740,811 | 4/1988 | Watanabe | 355/7 X |
| 4,743,945 | 5/1988 | Ito et al. | 355/14 SH |
| 4,743,946 | 5/1988 | Nishimori et al. | 355/14 C |
| 4,745,437 | 5/1988 | Oka et al. | 355/14 CH |
| 4,746,954 | 5/1988 | Matuura et al. | 355/14 D |
| 4,754,301 | 6/1988 | Kasamura et al. | 355/3 DD |
| 4,772,921 | 9/1988 | Ito | 355/14 SH |

FOREIGN PATENT DOCUMENTS

| | | |
|---|---|---|
| 48-22212 | 7/1973 | Japan . |
| 51-134635 | 11/1976 | Japan . |
| 54-30833 | 3/1979 | Japan . |
| 60-170868 | 9/1985 | Japan . |
| 60-238864 | 11/1985 | Japan . |
| 61-72270 | 4/1986 | Japan . |
| 61-203474 | 9/1986 | Japan . |

*Primary Examiner*—R. L. Moses

*Attorney, Agent, or Firm*—Burns, Doane, Swecker & Mathis

[57] ABSTRACT

A single-scan, multi-color image forming apparatus includes a document support for the support of an original document and a scanner, including a light source that is supported for movement from one end of the document support toward the opposite end for scanning successive incremental areas of the original document placed on the document support. An editing lever is supported for movement along one side of the document support in a direction conforming to the direction of movement of the scanner. An image forming device forms, on a single copying sheet, images of portions of the original document, which are positioned upstream and downstream of the editing lever with respect to the scanning direction, in first and second colors respectively. Also, a control unit controls the exposure made by the scanner.

14 Claims, 7 Drawing Sheets

SINGLE SCAN, MULTICOLOR IMAGING FORMING APPARATUS CAPABLE OF ADJUSTING THE IMAGE DENSITY OF EACH COLOR

This application is a divisional, of application Ser. No. 07/172,493, filed Mar. 24, 1988 now abandoned.

BACKGROUND OF THE INVENTION

1. Field of the Invention

The present invention generally relates to a multicolor image forming apparatus having a capability of reproducing an image of an original document in a plurality of colors.

2. Description of the Prior Art

The multi-color image forming apparatus is a machine having a plurality of developing units disposed in the vicinity of an electrostatic latent image carrier and accommodating powdery developers of different colors one for each unit, the developing units being selectively brought into operation so that an image of an original document can be reproduced in any one of the colors.

With the multi-color image forming apparatus widespread today, it has become desired that, where the original document to be reproduced includes, other than a text, tables and/or photos, a copy or reproduction of the image of the original document can be made having portions corresponding in position to the tables and/or photos which are printed or reproduced in a color different from that of the remainder thereof for the purpose of emphasizing the tables and/or photos.

To cope with the desire, the assignee of the present invention has filed the Japanese Patent Application No. 62-15572 directed to a multi-color image forming apparatus capable of making a copy having predetermined portions reproduced in a plurality of selected colors in one cycle of electrophotographic image forming process.

Generally, with the image forming apparatus, a reproduced image can be obtained having a uniform image density selected by an operator of the apparatus before the image of the original document is scanned. However, in the case of the multi-color image forming apparatus of a type wherein a single cycle of scanning operation suffices for the multi-color image to be formed, the uniformity of the image density would often bring about some inconveniences.

By way of example, where the image of the original document has different portions, one portion bearing an photo and the other portion bearing a text, and if the density of the image of the original document as a whole expected to be reproduced is so selected that the eventually reproduced image of the photo portion can exhibit an acceptable tone, the image of the text portion will be reproduced pale. Conversely, if the selection of the density of the image expected to be reproduced is made in reference to the density of the text portion so that the text portion can exhibit an acceptable tone, the eventually reproduced image of the photo portion will not exhibit an acceptable tone.

While the adjustment of the density desired to be attained in the eventually reproduced image can be accomplished by adjusting the amount of light used to scan the original document and/or the amount of toner applied to the electrostatic latent image carrier, it is frequently experienced with the multi-color image forming apparatus that, for a given amount of light used to scan the original document, the eventually reproduced image as a whole will show an image density varying from portion to portion because the electrical characteristic, for example, the electrostatic charge property, varies from toner of one color to that of a different color. Again, it is often recognized rather desirable that, due to the difference in color quality, for example, a red-colored portion of the original document be reproduced somewhat pale as compared with the density of that portion in the original document. somewhat pale.

In view of the foregoing, the prior art is such that, when it comes to the color reproduction of the original document having text and photo portions with the use of the multi-color image forming apparatus, either the density of the eventually reproduced image of one of the text and photo portions has to be sacrificed, or a compromise has to be made between the densities of the respective images of the photo and text portions in such a way as to choose an average image density.

SUMMARY OF THE INVENTION

Therefore, the present invention has been devised with a view to substantially eliminating the above discussed inconveniences inherent in the prior art multicolor image forming apparatus and has for its primary object to provide an improved multi-color image forming apparatus which may be termed a single-scan, multicolor image forming apparatus capable of reproducing an image of an original document in any one of the colors and in which the expected image density can be adjusted for each color.

To this end, the single-scan, multi-color image forming apparatus in one embodiment herein disclosed comprises a document support for the support of an original document; a scanning means including a light source and supported for movement from one end of the document support towards the opposite end thereof for scanning successive incremental areas of the original document placed on the document support; a position assigning means for assigning an arbitrary position within the scope of movement of the scanning means; an image forming means for forming, on a single copying sheet, images of portions of the original document, which are positioned upstream and downstream of the indexing means with respect to the scanning direction, in first and second colors, respectively; and a control means for controlling the exposure made by the scanning means.

In another preferred embodiment of the present invention, the single-scan, multi-color image forming apparatus herein disclosed may further comprises a first density setting means operable in cooperation with the control means to adjust the density of the eventually reproduced image of that portion of the original document formed in the first color, and a second density setting means operable in cooperation with the control means to adjust the density of the eventually reproduced image of that portion of the original document formed in the second color.

The control means may be utilized to control the amount of light, produced by the light source, in dependence on the setting of the first density setting means when the scanning means scans that portion of the original document positioned upstream of the indexing means, and also in dependence on the setting of the second density setting means when the scanning means scans that portion of the original document positioned downstream of the indexing means.

BRIEF DESCRIPTION OF THE DRAWINGS

In any event, these and other objects and features of the present invention will become understood from the following detailed description taken in connection with a preferred embodiment thereof with reference to the accompanying drawings, in which.

DETAILED DESCRIPTION OF THE EMBODIMENT

Figure 1:
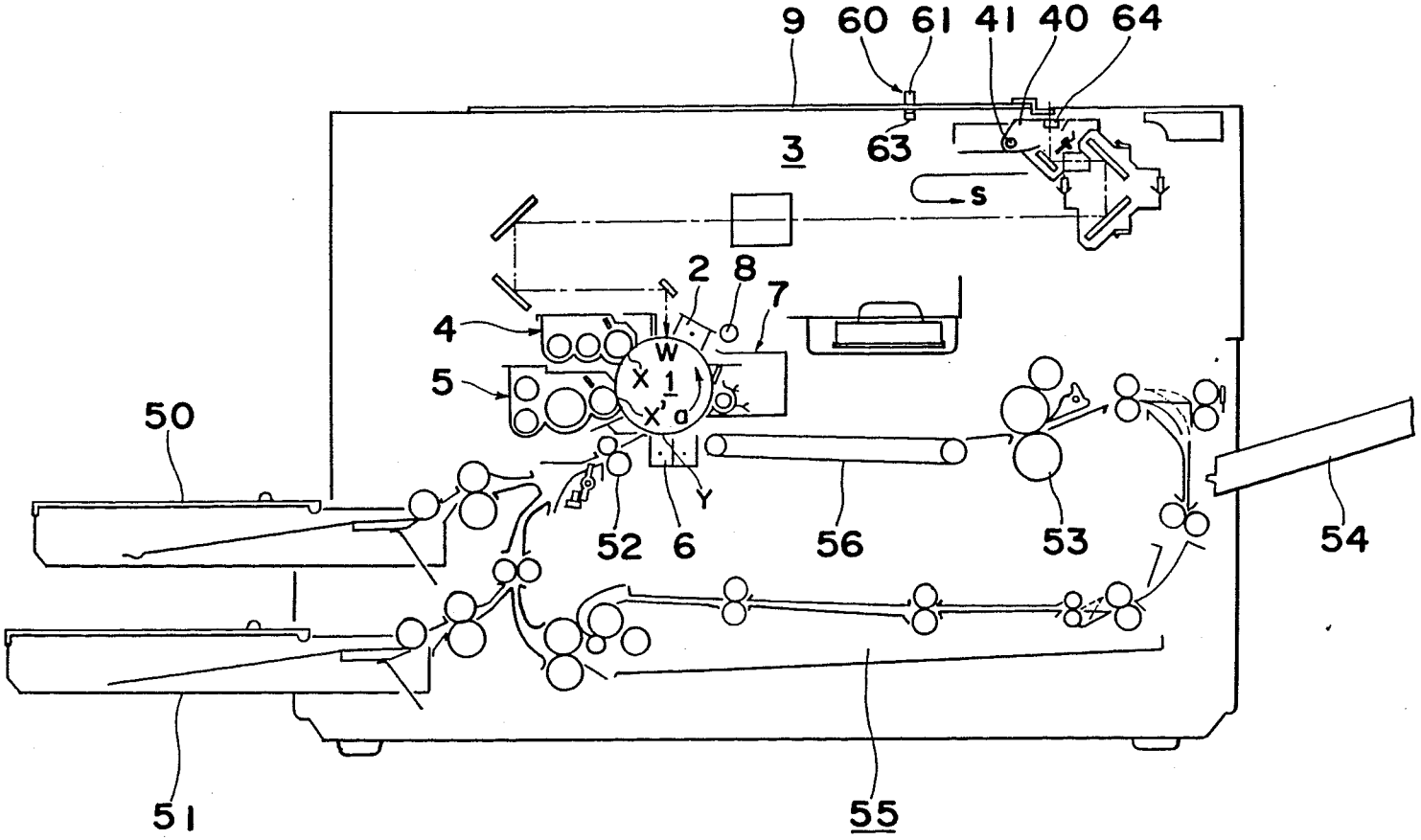
FIG. 1 is a schematic side view of a single-scan, multi-color image forming apparatus embodying the present invention.

Before the description of the preferred embodiment of the present invention proceeds, it is to be noted that like parts are designated by like reference numerals throughout the several views of the accompanying drawings.

With particular reference to FIG. 1, as an example of single-scan, multi-color image forming apparatus, a single-scan, bicolor electrophotographic copying machine is shown. This copying machine comprises a machine housing of generally rectangular box-like configuration, within which a photosensitive drum 1 is supported for rotation in one direction, shown by the arrow a, about a support shaft that defines the axis of rotation of such drum 1. As is well known to those skilled in the art, during one complete rotation of the photosensitive drum 1, the photosensitive drum 1 moves sequentially past a charging station at which an electrostatic charger 2 is disposed for electrostatically charging the outer peripheral surface of the drum 1 forming a photosensitive surface; an exposure station at which a ribbon of light carrying an image of that original document placed on a document support 9 which is successively scanned by a movable illuminator assembly or scanner 40 is projected onto the photosensitive surface of the drum 1 at an exposure point, shown by W, to form an electrostatic latent image on the photosensitive surface of the drum 1 in a pattern complemental to the image of the original document; a developing station at which a developer material is applied to develop the electrostatic latent image into a visible powder image; a transfer station Y at which a transfer charger 6 is disposed for transferring the powder image is onto a copying sheet supplied selectively from one of paper supply units 50 and 51 by way of a timing roller pair 52 synchronized with the rotation of the drum 1; and a cleaning station at which a cleaning unit 7 and an eraser lamp 8 are disposed one after another with respect to the direction a of rotation of the drum 1 for removing residue toner and residue electrostatic charge remaining on the photosensitive surface of the drum 1, respectively, in readiness for the next cycle of electrophotographic copying process.

The copying sheet having the powder image which has been transferred from the drum 1 at the transfer station is conveyed by a delivery conveyor 56 towards a fixing roller pair 53 and, after having been thermally fixed on the copying sheet as the latter pass through the fixing roller pair 53, transported towards a copy receiving tray 54.

The scanner 40 referred to above which is movable in a direction shown by the arrow s for scanning successive incremental portions of the original document placed on the document support 9 forms a part of an optical system generally identified by 3. This optical system 3 also comprises an illuminator lamp 41 capable of emitting a ribbon of light used to illuminate that successive incremental portions of the original document as the scanner 40 moves in the direction s, and a plurality of optical elements such as an objective lens assembly and reflecting mirrors for guiding and projecting the ribbon of light, which has been reflected from the original document and therefore carrying the image of the original document, onto the photosensitive surface of the drum 1 at the exposure point W.

Where the single-scan, bicolor copying machine such as in the illustrated instance is of a type having a single side copying mode, in which a copy can be made on one surface of the copying sheet, and a double side copying, or duplex copying, mode which can be selected one at a time according to the will of an operator, and if the machine is set under the duplex copying mode, the copying sheet having one surface fixed with the image of the original document is, after the passage thereof through the fixing roller pair 53, transported towards a duplex unit generally identified by 55. The duplex unit 55, the details of which are well known in the art, is operable to turn the copying sheet so that the surface of the same copying sheet opposite to the surface on which the image of the original document has already been reproduced and then to feed it towards the transfer station Y through the timing roller pair 52 for receiving a similarly formed powder image from the drum 1 during the subsequent cycle of electrophotographic copying process. The copying sheet is thereafter conveyed towards the copy receiving tray 54 through the delivery conveyor 56 by way of the fixing roller pair 53.

The developing station employed in the illustrated copying machine includes a first developing site X at which a first developing unit 4 is disposed, and a second developing site X' at which a second developing unit 5 is disposed, the first developing site X being located on a trailing side of the second developing site X' with respect to the direction a of rotation of the photosensitive drum 1. For the purpose of the multi-color image copying, the first and second developing units 4 and 5 are selectively brought into operation during each complete rotation of the drum 1, however, the illustrated copying machine can be used as a generally popular, single-color copying machine if either one of the first and second developing units is utilized.

Furthermore, the illustrated copying machine, because of its capability of making a copy of the original document having the selected portions reproduced in different colors, is provided with an image editing mechanism 60 while the first and second developing units 4 and 5 and an operating panel 70 (FIG. 8) are specially designed correspondingly.

The details of each of the first and second developing units 4 and 5 will now be described, it being however to be noted that the first and second developing units 4 and 5 are of identical construction and therefore reference will be made to only one of them in describing the structure thereof.

Figure 2:
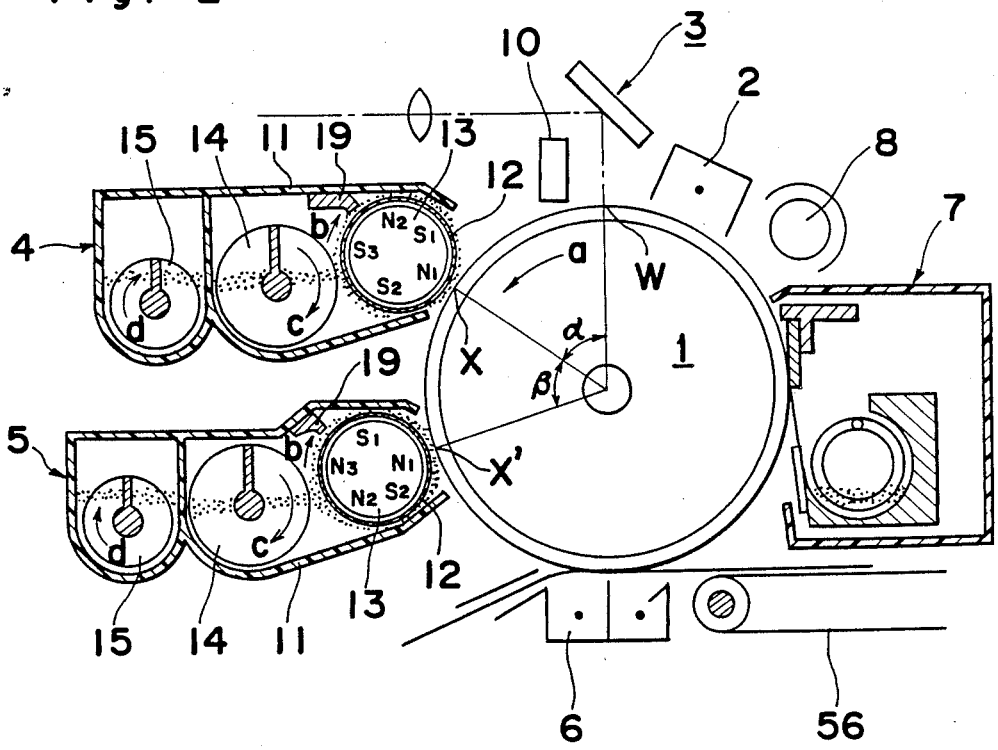
FIG. 2 is a schematic side sectional view, on an enlarged scale, of a portion of the apparatus, showing a photosensitive drum and associated components disposed therearound.
Figure 3:
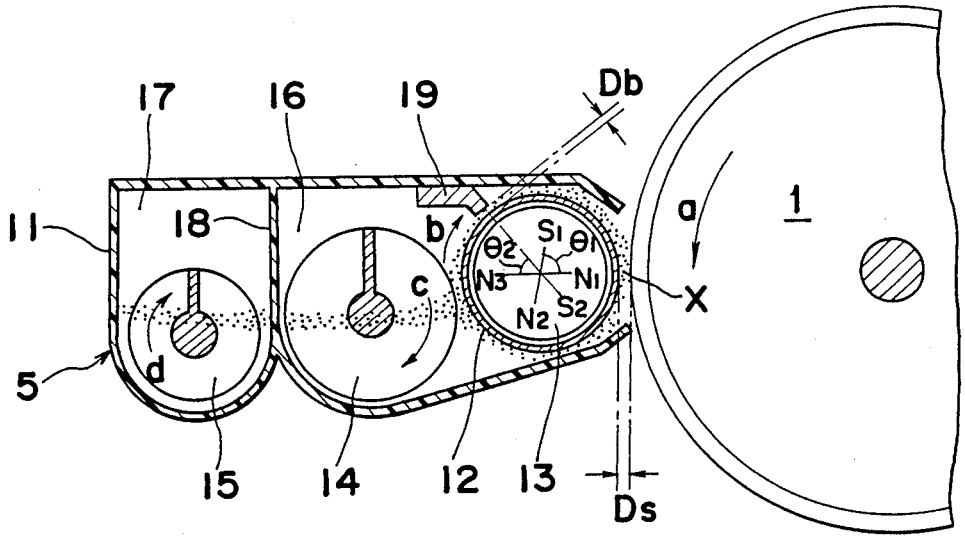
FIGS. 3 and 4 are side sectional views, on a further enlarged scale, showing one of developing units in relation to the photosensitive drum in different operative positions, respectively.
Figure 4:
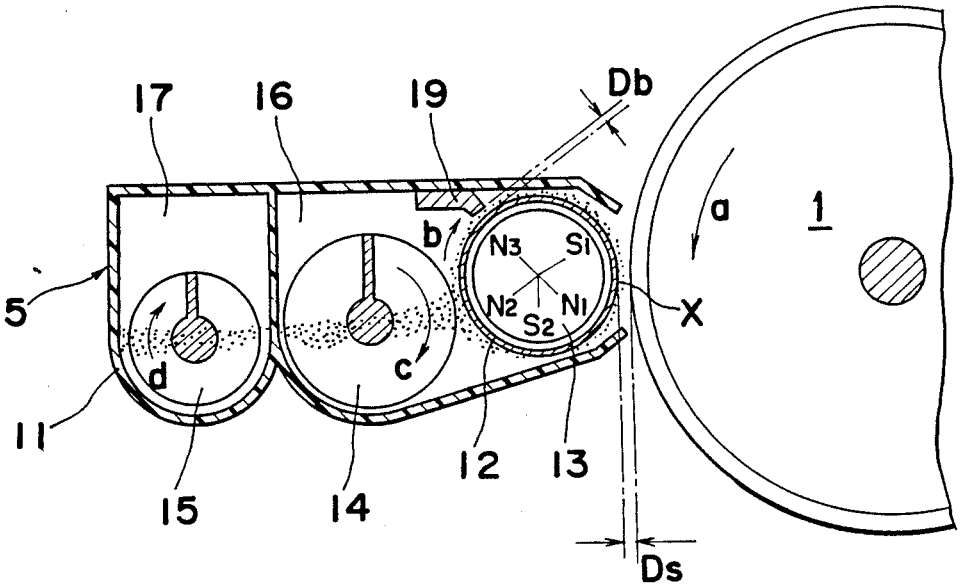

Referring now to FIGS. 2 to 4, the developing unit 4 or 5 comprises a casing or tank 11, the interior of which is divided by a partition wall 18 into receiving and dispensing chambers 17 and 16 which are communicated with each other at opposite sides of the tank 11, as viewed in a direction parallel to the axis of rotation of the drum 1, to form a recirculating passage for the flow of a mass of toner particles from the receiving chamber 17 back to the receiving chamber 17 via the dispensing chamber 16. The developing unit 4 or 5 also comprises a screw feeder 15 disposed rotatably within the receiving chamber 17 so as to extend generally parallel to the axis of rotation of the drum 1, a supply roller 14 disposed rotatably within the dispensing chamber 18 so as to extend generally parallel to the axis of rotation of the drum 1, and a developing sleeve 12 positioned on one side of the supply roll 14 remote from the screw feeder 15 and disposed rotatably within the dispensing chamber 16 with a portion of the outer periphery thereof exposed outwardly through an associated wall portion of the tank 11 to confront the first or second developing site X or X' on the photosensitive drum 1.

The screw feeder 15, the supply roller 14 and the developing sleeve 12 are drivingly coupled to a common drive motor or separate drive motors so that all of them can be driven in the same direction, shown by the respective arrows d, c and b, that is, clockwise as viewed in any one of FIGS. 2 to 4.

The developing sleeve 15 is in the form of a hollow cylinder made of non-magnetizeable, electroconductive material and having a predetermined diameter, for example, 24.5 mm, and has its outer peripheral surface roughened finely by the use of a sand blasting technique. That portion of the outer periphery of the developing sleeve 15, which is exposed outwardly of the tank 11 so as to confront the first or second developing site X or X' forms a developing gap Ds of, for example, 0.6 mm, between it and a portion of the photosensitive surface of the drum 1 confronting the first or second developing site X or X'. It is to be noted that the angle of rotation of the drum 1 from the exposure point W to the associated first or second developing site X or X' is chosen to be $\alpha$ or $(\alpha+\beta)$. By way of example, the angle $\alpha$ may be 56° and the angle $\beta$ may be 52°.

A bristle height adjustment 19 of a generally elongated plate-like configuration is secured to a top wall portion of the tank 11 within the dispensing chamber 16 so as to extend parallel to the developing sleeve 12. The bristle height adjustment 19 is so supported and so positioned on one side of the developing sleeve 12 generally opposite to the associated developing site X or X' with respect to the axis of rotation of such developing sleeve 12 that one side edge of the bristle height adjustment 19 closest to the developing sleeve 12 can be spaced a distance Db of, for example, 0.4 mm, from the outer peripheral surface of the developing sleeve 12.

Within the hollow of the developing sleeve 12 in each of the first and second developing units 4 and 5, a magnet roller 13 having a plurality of generally magnet bars embedded in a peripheral region thereof so as to extend in a direction axially of the sleeve 12. In the illustrated instance, since only one of the opposite magnetic poles of each magnet bar is utilized for applying toner particles onto the photosensitive surface of the drum 1, these magnet bars are identified by S1, S2, S3, N1 and N2 in terms of the respective poles that are utilized, with these reference characters "S" and "N" being descriptive of the magnetic polarity utilized. These magnet poles S1 to S3, N1 and N2 are so selected that the magnet pole N1 can emanate a magnetic force of 1,000 Gausses, each of the magnet poles N2 and N3 can emanate a magnetic force of 500 Gausses and each of the magnet poles S1 and S2 can emanate a magnetic force of 800 Gausses.

These magnet poles S1 to S3, N1 and N2 are so positioned that, as best shown in FIG. 3, the center of the magnet pole N1 can occupy a position spaced a predetermined angle $\theta 1$ of, for example, 80° from the center of the magnet pole S1 in a direction clockwise about the longitudinal axis of the magnet roller 13 and that the center of the magnet pole N3 can occupy a position spaced a predetermined angle $\theta 2$ of, for example, 40° from that side edge of the bristle height adjustment 19 in a direction counterclockwise about the longitudinal axis of the magnet roller 13 when the magnet pole N1 is in position to confront the photosensitive surface of the drum 1.

The magnet roller 13 of the above described construction for each of the first and second developing units 4 and 5 is adapted to be driven by a drive means such as, for example, an solenoid operated actuator to rotate about the longitudinal axis thereof between first and second positions spaced a predetermined angle of, for example, one half of the angle $\theta 1$ of spacing between the magnet poles S1 and N1. More specifically, when the magnet roller 13 is in the first position, the magnet pole N1 on the magnet roller 13 confronts the photosensitive surface of the drum 1 and the magnet pole N3 is moved the angle $\theta 2$ clockwise about the longitudinal axis of the magnet roller 13 from the position of that side edge of the bristle height adjustment 19, as shown in FIG. 3. On the other hand, when the magnet roller 13 is in the second position, the magnet pole N3 confronts that side edge of the bristle height adjustment 19 and a portion of the peripheral surface of the magnet roller 13 intermediate between the neighboring magnet poles N1 and S1 is confronts the photosensitive surface of the drum 1.

Figure 6:
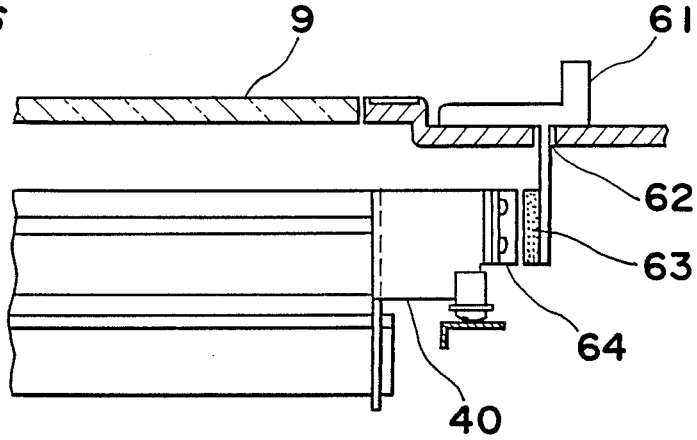
FIG. 6 is a schematic sectional view showing a portion of the image editing mechanism.
Figure 7:
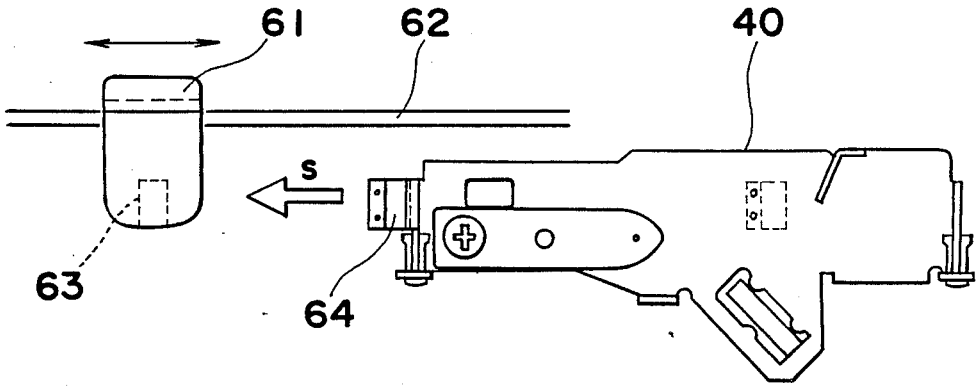
FIG. 7 is a schematic diagram showing another portion of the image mechanism.

The details of the image editing mechanism 60 will now be described with particular reference to FIGS. 5 to 7. The image editing mechanism 60 includes a setting lever 61 supported in a longitudinal guide slot 62, defined in a top panel of the machine housing so as to extend parallel to the scanning direction of the scanner 40, for sliding movement over a distance defined generally by the length of the longitudinal guide slot 62. This setting lever 61 includes a leg extending downwardly through the guide slot 62 into the machine housing, the free, lower end of said leg having a magnet 63 rigidly secured thereto.

Figure 5:
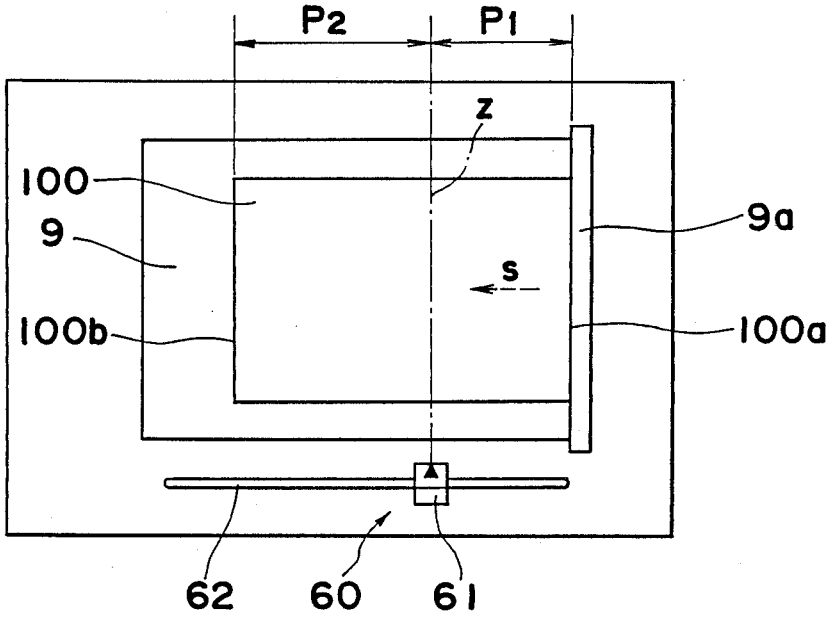
FIG. 5 is a schematic top plan view of a portion of a top panel of a machine housing of the image forming apparatus, in which portion an image editing mechanism is disposed.

As best shown in FIG. 5, the guide slot 62 is positioned along one side edge of the document support 9 which may be a generally rectangular glass plate mounted on the top panel of the machine housing. The document support 9 includes a scale 9a, rigidly mounted on a right-hand end of the document support 9 as viewed in FIG. 5, to which scale 9a one edge 100a of an original document 100 to be copied and, therefore, placed on the document support 9 is aligned. The setting lever 61 is movable along the guide slot 62 and, hence, the document support 9 between spaced apart end positions spaced lengthwise of the guide slot 62, one of said end positions being aligned with one side edge of the scale 9a to which the edge 100a of the original document 100 is abutted. The position of the setting lever 61 on the guide slot 62 defines first and second image areas P1 and P2 of the original document 100, the first image area P1 being located on one side of the position of the setting lever 61 adjacent the scale 9a while the second image area P2 is located on the other side of the position of the setting lever 61 remote from the scale 9a as indicated in FIG. 5. The setting lever 61 and the magnet 63 define a position assigning arrangement that is adapted to assign an arbitrary position along the document support within the scope of movement of the scanning means.

Figure 11:
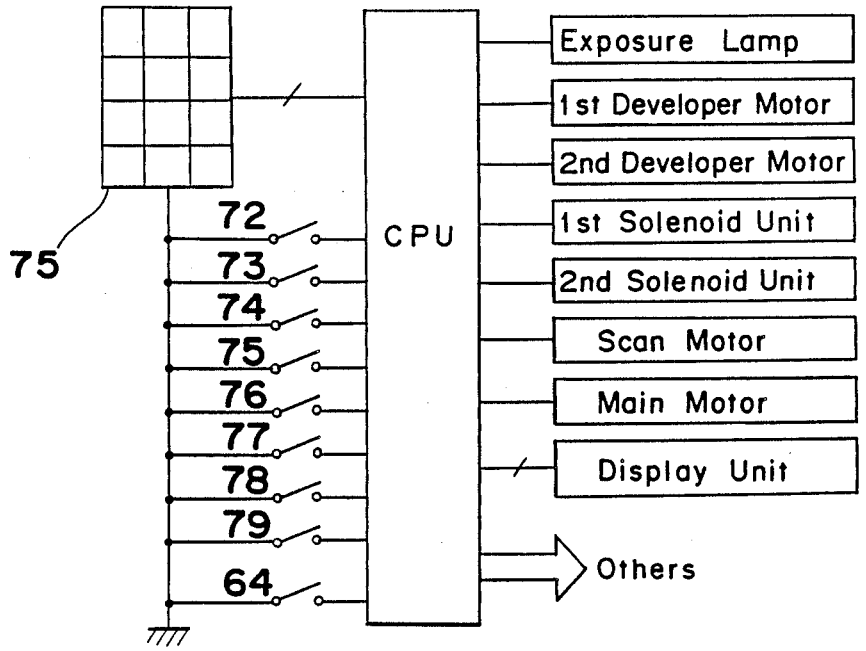
FIG. 11 is a circuit block diagram showing the control means.
Figure 12:
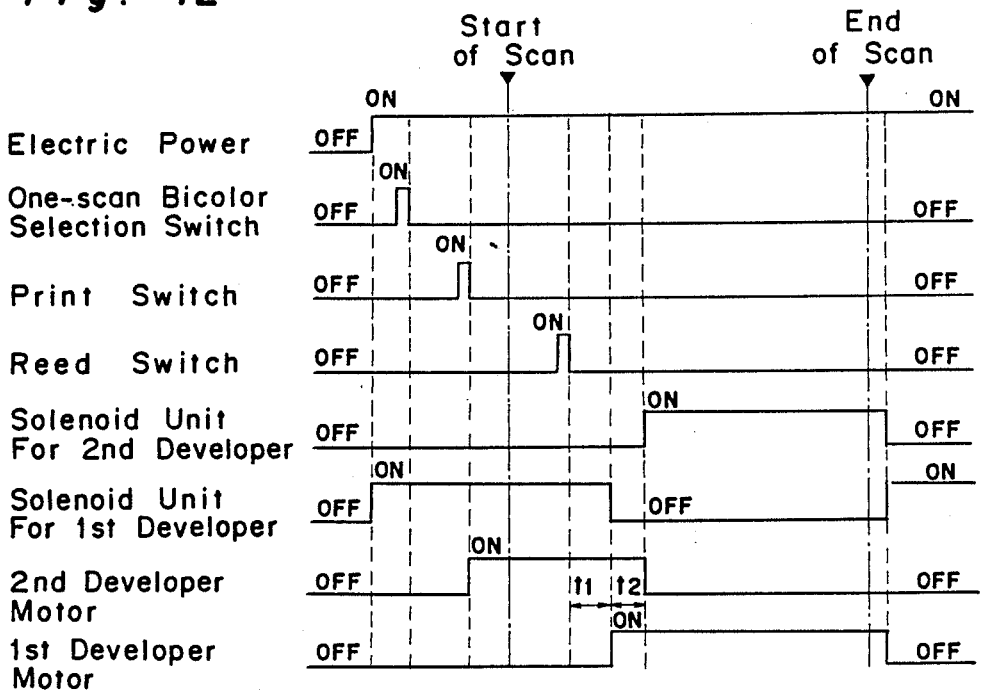
FIG. 12 is a timing chart showing the timed relationship of operation of various components used in the apparatus.

The image editing mechanism 60 also includes a reed switch 64 mounted on the scanner 40 for movement together therewith, said reed switch 64 being used to detect the magnet 63 fast with the setting lever 61 to provide an output signal indicative of the position of the magnet 63 and, hence, the position of the setting lever 61 to a control unit shown in FIG. 11. Specifically, when the reed switch 64 fast with the scanner 40 moves past the magnet 63 during the scanning movement of the scanner 40, the reed switch 64 is switched on to provide the signal indicative of the position of the setting lever 61 to the control unit.

Figure 8:
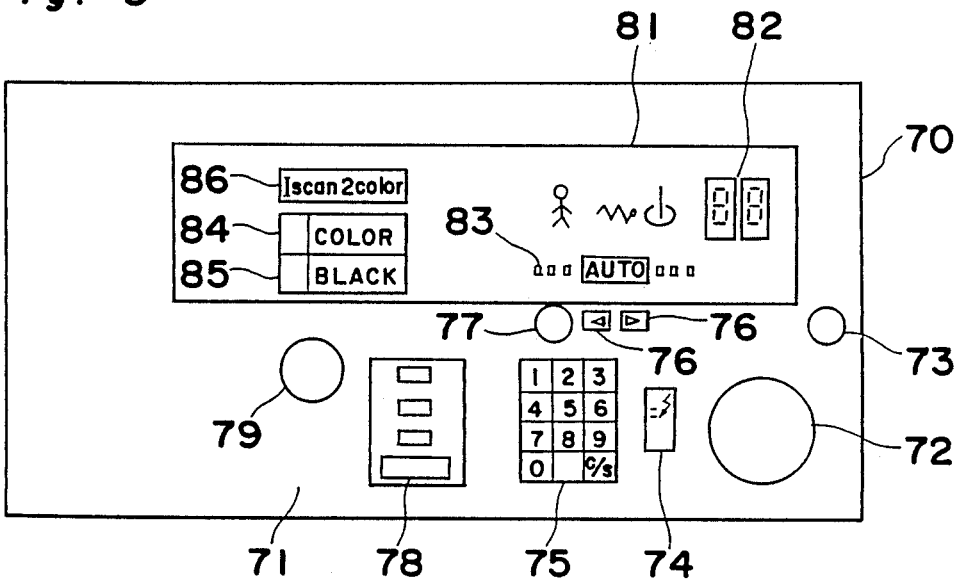
FIG. 8 is a schematic front elevational view of an operating panel disposed on the machine housing.

The machine housing has an operating panel 70 installed on the machine housing, for example, the top panel of the machine housing, at a location convenient for an operator of the machine to access, the details of said operating panel 70 being described with particular reference to FIG. 8.

As shown in FIG. 8, the operating panel 70 includes an operating section 71 and a display section 81. The operating section 71 includes a PRINT key 72, an ALL CLEAR key 73, an INTERRUPTION key 74, a plurality of numerical input keys 75, density adjusting keys 76, a density preset key 77, a color selection key 78 and a one-scan bicolor selection key 79. The display section 81 includes a display LED (light emitting diode) window 82 for displaying the number of copies desired to be made, a density display LED window 83, a first display LED window 84 adapted to be lit when the image density associated with the first image area P1 is adjusted, a second display LED window 85 adapted to be lit when the image density associated with the second image area P2 is adjusted, a mode display LED window 86 adapted to be lit when the one-scan bicolor selection key 79 is depressed, that is, switched on, and some other display LED windows for the display of error messages. The various keys referred to in the description of the operating section 71 are to be understood as analogous to respective electric switches. These keys and, hence, switches are, as shown in FIG. 11, connected with a central processing unit forming a part of the control unit.

Figure 9:
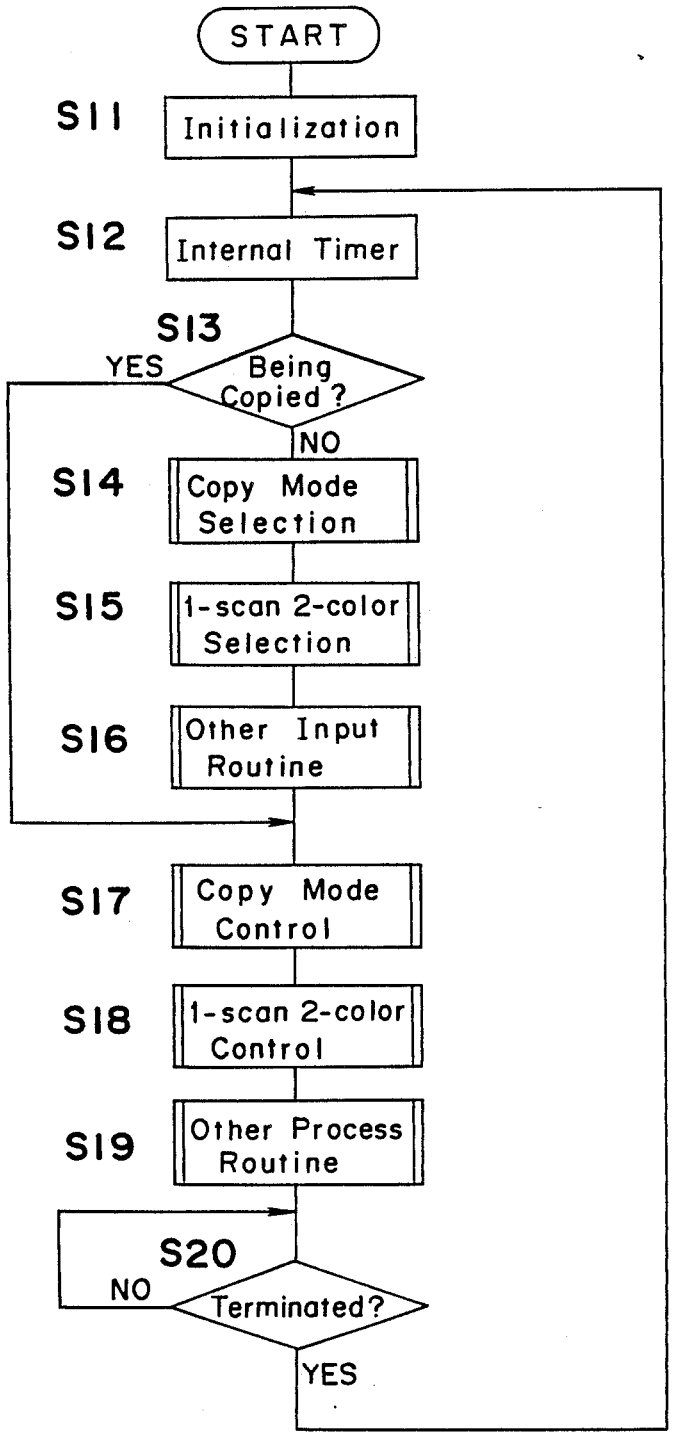
FIG. 9 is a flowchart showing a main routine executed by a control means used in the apparatus.

The sequence of operation of the control unit will now be described with particular reference to FIGS. 9 and 10. FIG. 9 illustrates a main routine executed to control the overall operation of the copying machine. When the copying machine is first powered, a built-in microcomputer is initialized at step S11. Following the initialization, and at step S12, an internal timer is set to a one-routine time required to execute the subsequent processes. Specifically, in the illustrated copying machine, this process is executed for each one-routine time which is a very short hour.

At step S13, the microcomputer makes a decision to determine if the copying operation is executed. If the copying operation is executed, the program flow proceeds to step S17. On the other hand, if the copying operation is not executed, the program flow proceeds to step S14 at which an input routine for selecting one of the color copy and the black copy is executed, followed by step S15 at which, in the event that the one-scan, bicolor mode is selected, a processing routine as will be described later with reference to FIG. 10 is executed.

After the execution at step S16 of other input routines including the entry of the number of copies desired to be made, processing routines are successively executed at steps S17 to S19. Specifically, during the execution of a copying mode control routine at step S17, the normal copying operation is performed, and at step S18 the one-scan, bicolor copying operation as will be described later is performed. At step S19 other processes are performed, and at subsequent step S20 a decision is made to determine if the time set in the internal timer at step S12 has terminated. If the time set in the internal timer has terminated, the program flow return to step S12, but if it is not, the microcomputer waits until the termination of the time set in the internal timer.

The one-scan, bicolor selection routine will now be described with particular reference to FIG. 10. This routine is executed in the event that the one-scan, bicolor selection key 79 has been depressed, that is, switched on as determined at a decision block S21. If the one-scan, bicolor selection key 79 is not depressed, however, the program flow returns to the main routine of FIG. 9 to execute step S16.

At step S22, as a result of the depression of the one-scan, bicolor selection key 79 the display window 86 is lit to provide a visual indication that the copying machine is in a mode effective to perform the one-scan, bicolor copying operation. Subsequent to the lighting of the display window 86, the display window 84 is lit at step S23 to invite the operator to set the desired density of an eventually reproduced image of a first portion of the original document 100 covered within the first image area P1. Should the operator consider that the image density must be adjusted in reference to the tone of that first portion of the original document 100 covered within the first image area P1, the density adjusting key 76 has to be manipulated at step S24.

Thereafter, the microcomputer determines at step S25 if the PRINT key 72 has been depressed. If the result of decision at step S25 indicates "YES", the density set at step S24, that is, the density set at the time PRINT key 72 has been depressed, is stored at step 36 in a memory A for the storage of the desired density of the eventually reproduced image of that first portion of the original document 100, followed by step S37 at which the content of the memory A, that is, the density equal to the desired density of the eventually reproduced image of that first portion of the original document 100, is stored in a memory B for the storage of the desired density of the eventually reproduced image of that second portion of the original document 100 covered within the second image area P2. Thereafter, the program flow return to the main routine to execute the step S16, et. seqq.

Figure 10:
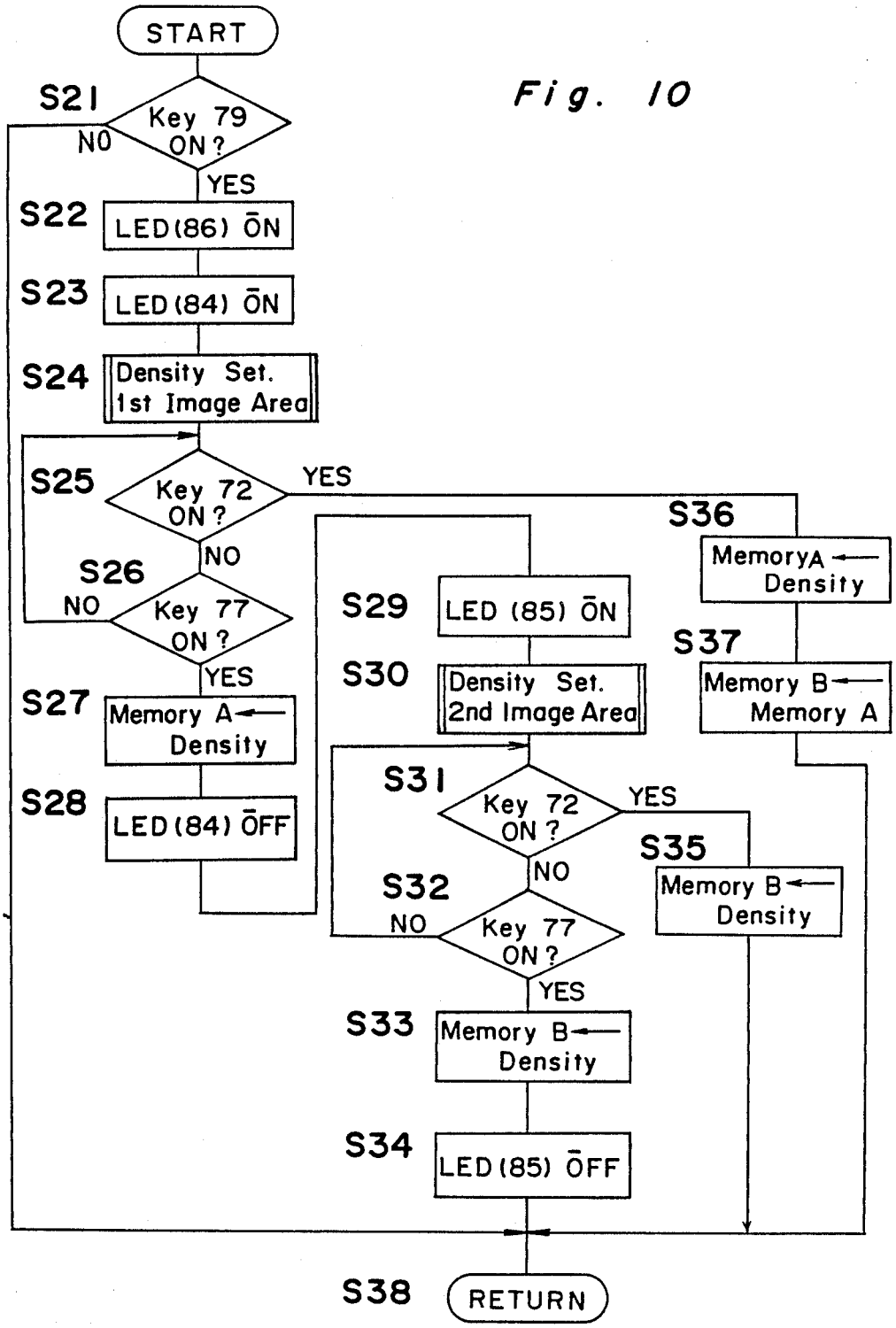
FIG. 10 is a flowchart showing a single-scan two-color selecting routine executed by the control means in the apparatus.

In the routine of FIG. 10 so far described above, if the PRINT key 72 is depressed subsequent to the setting of the desired density at step S24, the first and second portions of the original document 100 covered respectively within the first and second image areas P1 and P2 can be eventually reproduced on a copying sheet in equal density set at step S24.

Referring to step S25, if the microcomputer finds that the PRINT key 72 has not been depressed at step S25, that is, if the result of decision at step S25 indicates "NO", the next succeeding decision is made at step S26 to determine if the density preset key 77 has been depressed. If the density preset key 77 has not been depressed, the microcomputer waits until it is depressed, however, the depression of the density preset key 77 causes the program flow to proceed to step S27 at which the density set at step S24 is stored in the memory A, followed by step S28 at which the display window 84 is turned off. Subsequent to step S28, and at step S29, the display window 85 is lit to provide a visual indication that the setting of the desired density associated with the first image area P1 has been performed while the operator is invited to set the desired density of the eventually reproduced image of that second portion of the original document 100 covered within the second image area P2.

Where the operator considers that the density of the eventually reproduced image of the second portion of the original document 100 covered within the second image area P2 should be adjusted to a value different from that of the eventually reproduced image of the first portion of the same original document 100 covered within the first image area P1, the density adjusting key 76 has to be manipulated at step S30. Where the operator considers to the contrary, that is, where the density associated with the second image area P2 may be identical with that associated with the first image area P1, no density adjustment is required.

At step S31 a decision is made to determine if the PRINT key 72 has been depressed. If it is "YES", the density set at step S30, that is, the density set at the time the PRINT key 72 has been depressed, is stored in the memory B at step S35, followed by the return to the main routine of FIG. 9.

On the other hand, where the result of the decision at step S32 indicates that the PRINT key 72 has not been depressed, another decision is made at step S32 to determine if the density preset key 77 has been depressed. Should the density preset key 77 has not been depressed, the microcomputer waits until the PRINT key 72 or the density preset key 77 is depressed. However, if the density preset key 77 has been depressed as determined at step S32, the preset density is stored in the memory B at step S33, followed by step S34 at which the display window 85 is turned off, thereby completing the presetting of the density, after which the program flow returns to the main routine of FIG. 9.

As hereinbefore described, when after the setting of the density associated with the first image area P1 the density preset key 77 is depressed, that is, switched on without the PRINT key 72 being depressed, the densities associated respectively with the first and second image areas P1 and P2 can be separately and independently set and stored.

The one-scan, bicolor copying operation will now be described with reference to the timing chart shown in FIG. 11.

Assuming that the copying machine is electrically powered with a power main switch (not shown) turned on, the placement of the original 100 on the document support 9 is followed by the adjustment of the setting lever 61 along the guide slot 62 to a desired position at which the original document 100 is divided into the first image area P1, which is desired to be copied black-and-white, and the second image area P2 which is desired to be copied in a color.

At the time the machine is powered, a first developer solenoid unit, i.e., a solenoid unit for the first developing unit 4, is activated to permit the first developing unit 4 to assume a condition wherein, as shown in FIG. 4, an intermediate portion between the magnet poles N1 and S2 can confront the photosensitive surface of the drum 1 while the second developing unit 5 assumes a condition wherein, as shown in FIG. 3, the magnet pole N1 confronts the photosensitive surface of the drum 1. When the PRINT key 72 is subsequently depressed during this condition, the second developing unit 5 accommodating a mass of black-colored toner particles is automatically driven to execute a normal copying operation. However, where the one-scan, bicolor selection key 79 is depressed, that is, switched on, a condition ready to execute a one-scan, bicolor copying operation is established It is, however, to be noted that no one-scan, bicolor copying operation will be performed when the one-scan, bicolor selection key 79 is depressed during the copying operation being performed.

Upon the depression of the one-scan, bicolor selection key 79, a copying mode is switched over from the normal copying mode onto the one-scan, bicolor copying mode.

Then, in accordance with the one-scan, bicolor selection routine as hereinbefore described, the densities associated respectively with the first and second image areas P1 and P2 are set, which densities are then stored in the memories A and B.

When the PRINT key 72 is depressed, a developer motor (not shown) for the second developing unit 5 is driven to drive the developing sleeve 12, the supply roller 14 and the screw feeder 15 in the respective directions as shown by b, c and d, wherefore the black-colored toner particles contained in the developing tank 11 is, while mixed by the rotation of the supply roller 14 and the screw feeder 15, circulated from the supply chamber 17 back to the supply chamber 17 through the dispensing chamber 16, a portion of the toner particles within the dispensing chamber 16 being supplied by the supply roller 14 on to the outer peripheral surface of the developing sleeve 12 to form magnetic brushes on the developing sleeve 12.

The magnetic brushes so formed on the developing sleeve 12 are adjusted by the bristle height adjustment 19 during the rotation of the developing sleeve 12 to a height corresponding to the distance Db and is then successively supplied towards the developing site X' to develop an electrostatic latent image on the photosensitive surface of the drum 1 into a visible powder image.

Also, simultaneously with the depression of the PRINT key 72, the scanner 40 starts its movement in the direction s to scan the successive incremental areas of that portion of the original document 100 covered within the first image area P1. As a result of this, ribbons of light corresponding to the successive incremental areas of that portion of the original document 100 so scanned, which start from the edge 100*a* of the original document 100, are successively projected at the exposure point W onto the photosensitive surface of the drum 1 at an amount of exposure corresponding to the density stored in the memory A, thereby to form an electrostatic latent image corresponding to that portion of the original document 100 covered by the first image area P1. This electrostatic latent image is first developed by the second developing unit 5.

When the reed switch 64 is subsequently switched on in response to the detection of the magnet 63 moving together with the scanner 40 then scanning the original document 100, a signal indicative of the detection of the passage of the magnet 63 relative to the reed switch 64 is generated from the reed switch 64 to the control unit. Then, in response to a signal generated from the control unit, ribbons of light corresponding to the successive incremental areas of that portion of the original document 100 covered within the second image area P2 are successively projected onto the photosensitive surface of the drum 1 at an amount of exposure corresponding to the density stored in the memory B, thereby to form an electrostatic latent image corresponding to that portion of the original document 100 covered by the second image area P2.

It is to be noted that the boundary Z between the electrostatic latent images on the photosensitive surface of the drum 1 which are formed in correspondence with the first and second image areas P1 and P2 is aligned with the exposure point W on the photosensitive drum 1 at the moment the reed switch 64 detects the relative passage of the magnet 63 and that, for a time (t1=0.22 sec.) up until the boundary Z moves from the exposure point W to the developing site X for the first developing unit 4, only the second developing unit 5 continues to be operated.

After the time t1 subsequent to the closure of the reed switch 64, and when the boundary Z between the electrostatic latent images arrives at the developing site X, the first developer motor, that is, a motor for the first developing unit 4 is driven and, at the same time, the first developer solenoid unit is switched off.

In this way, the first developing unit 4 is brought to a condition similar to that shown in FIG. 3 in connection with the second developing unit 5, to drive the developing sleeve 12, the supply roller 14 and the screw feeder 15 in the respective directions as shown by b, c and d, wherefore the colored toner particles contained in the developing tank 11 are, while mixed by the rotation of the supply roller 14 and the screw feeder 15, circulated from the supply chamber 17 back to the supply chamber 17 through the dispensing chamber 16, a portion of the toner particles within the dispensing chamber 16 being supplied by the supply roller 14 on to the outer peripheral surface of the developing sleeve 12 to form magnetic brushes on the developing sleeve 12. Those magnetic brushes are, after having been adjusted in height by the bristle height adjustment 19, successively supplied towards the developing site X to develop an electrostatic latent image of that portion of the original document 100, covered within the second image area P2, into a visible powder image.

After a predetermined time t2 subsequent to the start of the first developer motor, that is, after a time (t=0.2 sec.) required for the boundary Z of the electrostatic latent images to move from the developing site X to the developing site X' associated with the second developing unit 5, the motor for the second developing unit 5 is switched off and a second developer solenoid unit, that is, a solenoid unit for the second developing unit 5 is switched on. Therefore, the second developing unit 5 is brought to a condition as shown in FIG. 4 wherein an intermediate portion between the magnet poles N1 and S1 confronts the photosensitive surface of the drum 1 while the developing sleeve 12, the supply roller 14 and the screw feeder 15 are brought to a halt, thereby completing the developing, with the black-colored toner particles, of the electrostatic latent image corresponding to the first image area P1.

As hereinbefore described, during a period of time from the start of the scanning to the end of the scanning, the color is changed over from black to color at the preset position and a copy having the selected two portions reproduced in two colors can be obtained.

In describing the foregoing embodiment of the present invention, the adjustment of the density to the desired density has been described as carried out by adjusting the amount of exposure. However, the identical purpose can be accomplished if the developing bias voltage to be applied to each of the developing sleeves is adjusted and/or the number of revolution of each of the developing sleeves is adjusted.

In addition, although reference has been made to the use of two colors, black and color, that are alternately chosen, a pattern of color distribution may not be always limited to that described, but any pattern may be employed with corresponding increase in number of the setting lever or corresponding change in sequence of operation of the developing units.

Moreover, the number of colors may not be limited to those in the illustrated embodiment and may be more than two colors provided that the number of the developing units is correspondingly increased. By way of example, the use of the three or four developing units around the photosensitive drum makes it possible to make a copy reproduced in three or four colors.

Yet, in the foregoing description, it has been described that, when no developing is carried out, the developer motor is brought to a halt and the magnet roller 13 is driven to retract the magnet pole from the developing site X and also to a position confronting the bristle height adjustment 19. The magnet poles may not be always moved such as shown and described when the development is carried out and not carried out. However, the arrangement shown and described is advantageous in that the possibility of the magnetic brushes to contact the photosensitive surface of the drum 1 can be minimized to avoid any possible color mixing.

Although the present invention has been fully described in connection with the preferred embodiment thereof with reference to the accompanying drawings, it is to be noted that various changes and modifications are apparent to those skilled in the art. By way of example, while the first and second developing units have been described as accommodating respective masses of toner particles of different colors, they may contain respective masses of toner particles of the same color and, in such case, a copy having different portions reproduced in different density can be obtained.

Accordingly, such changes and modifications are to be understood as included within the scope of the present invention unless they depart therefrom.

I claim:

1. An image forming apparatus which comprises:

a document support for the support of an original document;

a scanning means including a light source and supported for movement from one end of the document support towards the opposite end thereof for effecting a slit-exposure of successive incremental areas of the original document placed on the document support;

a position assigning means for assigning an arbitrary position within the scope of movement of the scanning means;

an image forming means for forming, on a single copying sheet, images of portions of the original document, which are positioned upstream and downstream of the position assigning means with respect to the scanning direction, in first and second colors, respectively;

a density setting means for inputting a first condition concerned with the density of the image to be copied in the first color and for inputting a second condition concerned with the density of the image to be copied in the second color; and a control means for controlling the light source according to the first condition when one of the portions of the original document positioned upstream of the position assigning means is scanned by the scanning means and for controlling the light source according to the second condition when the other of the portions of the original document is scanned by the scanning means.

2. The apparatus as claimed in claim 1, wherein said image forming means comprises a first developing unit accommodating a developer material of the first color and a second developing unit accommodating a developer material of the second color.

3. The apparatus as claimed in claim 2, further comprising a detecting means for detecting the arrival the scanning means at the position assigned by the position assigning means and for generating an output signal indicative of such arrival, and a developer switching means operable in response to the output signal to switch over between the first and second developing units.

4. An image forming apparatus which comprises:

a document support for the support of an original document;

a scanning means including a light source and supported for movement from one end of the document support towards the opposite end thereof for effecting a slit-exposure of successive incremental areas of the original document placed on the document support;

a position assigning means for assigning an arbitrary position within the scope of movement of the scanning means;

an input means for inputting a first data concerned with the amount of exposure associated with one of the portions of the original document positioned upstream of the position assigning means and for inputting a second data concerned with the amount of exposure associated with the other of the portions of the original document positioned downstream of the position assigning means;

a control means for controlling the light source according to the first data when one of the portions of the original document positioned upstream of the position assigning means is scanned by the scanning means and for controlling the light source according to the second data when the other of the portions of the original document positioned downstream of the position assigning means is scanned by the scanning means; and an image forming means for forming, on a single copying sheet, respective images of the portions of the original document slit-exposed by the scanning means.

5. The apparatus as claimed in claim 4, wherein said image forming means comprises a first developing unit accommodating a first developer material and a second developing unit accommodating a second developer material, and a switching means for selectively driving one of the first and second developing units.

6. The apparatus as claimed in claim 5, further comprising a detecting means for detecting the arrival of the scanning means at a position of the position assigning means and for generating an output signal indicative of such arrival, said switching means operable in response to the output signal.

7. An image forming apparatus which comprises:

a document support for the support of an original document;

a scanning means including a light source and supported for movement from one end of the document support towards the opposite end thereof for effecting a slit-exposure of successive incremental areas of the original document placed on the document support;

a position assigning means for assigning an arbitrary position within the scope of movement of the scanning means;

a detecting means for detecting the arrival of the scanning means at a position of the position assigning means and for generating an output signal indicative of such arrival;

a control means for varying an output of the light source in dependence on the output signal from the detecting means; and an image forming means for forming, on a copying sheet, an image of the original document slit-exposed by the scanning means.

8. The apparatus as claimed in claim 7, further comprising a data input means for inputting a first data and for inputting a second data, and wherein said control means is operable first to control the light source according to the first data and then, in response to the output signal from the detecting means, to control the light source according to the second data.

9. The apparatus as claimed in claim 7, wherein said image forming means comprises a first developing unit accommodating a first developer material and a second developing unit accommodating a second developer material, said first and second developing units being selectively brought into operation in response to the output signal from the detecting means.

10. An image forming apparatus which comprises:

a support means for supporting an original document;

an illuminating means for illuminating the original document, said illuminating means being capable of varying an output thereof;

a first image forming means for forming an image of the illuminated original document in a first color;

a second image forming means for forming an image of the illuminated original document in a second color;

a density setting means for inputting a first condition concerned with the density of the image to be copied in the first color and for inputting a second condition concerned with the density of the image to be copied in the second color;

a first control means for selectively operating the first and second image forming means; and a second control means for varying the output of the illuminating means in accordance with the first condition and also for varying the output of the illuminating means in accordance with the second condition.

11. In an image forming apparatus comprising a document support on which an original document is supported, a scanner including a light source and supported for movement from one end of the document support towards the opposite end thereof for effecting a slit exposure of successive incremental areas of the original document placed on the document support, image forming means for forming the image of the original onto a single copy paper and a control which controls an output of the light source, a method for operating the control comprising the steps of:

assigning an arbitrary position within the scope of movement of the scanner;

initiating the movement of the scanner and adjusting the output of the light source to a first value;

detecting the arrival of the scanner at the assigned position; and varying the output of the light source to a second value in response to the detection.

12. The method as claimed in claim 11, further comprising the step of inputting the first and second values before the initiation of the movement of the scanner.

13. In an image forming apparatus comprising a document support on which an original document is supported, an illuminator which illuminates the original document placed on the document support, first image forming means for forming the image of the illuminated original in a first color, second image forming means for forming the image of the illuminated original in a second color, and a control which controls an output of the illuminator, a method for operating the control comprising the steps of:

selectively operating one of first and second image forming means;

adjusting the output of the illuminator to a first value when said first image forming means is selected; and adjusting the output of the illuminator to a second value when said second image forming means is selected.

14. The method as claimed in claim 13, further comprising the steps of inputting the first and second values before the initiation of the movement of the illuminator.

* * * * *